US009881525B2

(12) United States Patent
Flynn et al.

(10) Patent No.: US 9,881,525 B2
(45) Date of Patent: Jan. 30, 2018

(54) HANG TAB LABEL, ASSEMBLY, AND METHOD OF APPLICATION

(71) Applicants: Timothy J. Flynn, Key Largo, FL (US); Geoffrey T. Brossard, Crystal Lake, IL (US)

(72) Inventors: Timothy J. Flynn, Key Largo, FL (US); Geoffrey T. Brossard, Crystal Lake, IL (US)

(73) Assignee: Timothy J. Flynn, Key Largo, FL (US)

( * ) Notice: Subject to any disclaimer, the term of this patent is extended or adjusted under 35 U.S.C. 154(b) by 89 days.

(21) Appl. No.: 14/729,919

(22) Filed: Jun. 3, 2015

(65) Prior Publication Data

US 2015/0269872 A1 Sep. 24, 2015

Related U.S. Application Data

(62) Division of application No. 13/668,713, filed on Nov. 5, 2012, now abandoned.

(60) Provisional application No. 61/555,830, filed on Nov. 4, 2011.

(51) Int. Cl.
*G09F 3/02* (2006.01)
*G09F 3/10* (2006.01)

(52) U.S. Cl.
CPC ..... *G09F 3/10* (2013.01); *G09F 3/02* (2013.01); *G09F 2003/027* (2013.01); *Y10T 156/10* (2015.01); *Y10T 156/1034* (2015.01); *Y10T 156/1051* (2015.01)

(58) Field of Classification Search
None
See application file for complete search history.

(56) References Cited

U.S. PATENT DOCUMENTS

| | | | |
|---|---|---|---|
| 2,846,134 | A | 8/1958 | Moubayed |
| 3,065,946 | A | 11/1962 | Berkow |
| 3,289,831 | A | 12/1966 | Keating, Jr. |
| 3,290,808 | A | 12/1966 | Delitz |
| 4,518,086 | A | 5/1985 | Roccaforte |
| 4,863,128 | A | 9/1989 | Good |
| 4,890,809 | A | 1/1990 | Good |
| 5,048,676 | A | 9/1991 | Borgis et al. |
| 5,182,152 | A | 1/1993 | Ericson |
| 5,775,504 | A | 7/1998 | Menaged |
| 5,868,430 | A | 2/1999 | Kolosvary |
| 6,073,758 | A | 6/2000 | Webster et al. |
| 6,197,396 | B1 | 3/2001 | Haas et al. |
| 6,357,651 | B1 | 3/2002 | Flynn et al. |
| 6,375,239 | B1 | 4/2002 | Reed et al. |
| 6,382,676 | B1 | 5/2002 | Cochran et al. |
| 6,619,480 | B2 | 9/2003 | Smith |
| 6,994,307 | B2 | 2/2006 | Curtsinger et al. |
| 7,073,282 | B2 | 7/2006 | Savagian et al. |
| 7,140,136 | B2 | 11/2006 | Flynn et al. |

(Continued)

*Primary Examiner* — Barbara J Musser
(74) *Attorney, Agent, or Firm* — Pauley Erickson & Kottis

(57) ABSTRACT

A self-adhesive label for application to an object as a hang tab, without the need for a separate application device. The label includes a printable surface, a fold line dividing the label into two portions, and two matching hanger opening shapes, one on each of the two label portions. The matching hanger openings are reversely positioned with respect to each other to provide corresponding alignment upon folding the label about the object to align the matching hanger opening shapes to form a hanger opening. The label is particularly suited for use with retail product packaging used in hanging retail displays.

19 Claims, 5 Drawing Sheets

(56) References Cited

U.S. PATENT DOCUMENTS

| | | | |
|---|---|---|---|
| 7,534,476 | B2 | 5/2009 | Banks et al. |
| 7,579,059 | B2 | 8/2009 | Chamandy |
| 7,857,353 | B2 | 12/2010 | Kuranda et al. |
| 7,941,948 | B2 | 5/2011 | Bardolph et al. |
| 8,157,086 | B1 | 4/2012 | Gallegos et al. |
| 8,272,669 | B2 | 9/2012 | Flynn et al. |
| 8,455,074 | B2 | 6/2013 | Emmert |
| 8,579,878 | B2 | 11/2013 | Seidl |
| 2001/0005534 | A1 | 6/2001 | Pomerantz |
| 2004/0074116 | A1 | 4/2004 | Valenti, Jr. |
| 2004/0166286 | A1 | 8/2004 | Auchter et al. |
| 2005/0089663 | A1 | 4/2005 | Wong et al. |
| 2005/0126701 | A1 | 6/2005 | Hodsdon et al. |
| 2006/0225593 | A1 | 10/2006 | Flynn et al. |
| 2006/0228508 | A1 | 10/2006 | Flynn et al. |
| 2009/0091123 | A1 | 4/2009 | Conley et al. |
| 2010/0011635 | A1 | 1/2010 | Sipe et al. |
| 2013/0074388 | A1 | 3/2013 | Glass et al. |
| 2013/0240134 | A1 | 9/2013 | Flynn et al. |

HANG TAB LABEL, ASSEMBLY, AND METHOD OF APPLICATION

CROSS REFERENCE TO RELATED APPLICATION

This application is a divisional of U.S. patent Ser. No. 13/668,713, filed on 5 Nov. 2012 now abandoned, which claims the benefit of Provisional Patent Application Ser. No. 61/555,830, filed on 4 Nov. 2011. The co-pending parent Patent Application is hereby incorporated by reference herein in its entirety and is made a part hereof, including but not limited to those portions which specifically appear hereinafter.

FIELD OF THE INVENTION

This invention is directed to a label and application of a label to an object, and more particularly a self-adhesive label that functions as a hang tab when applied. The invention is also directed to a printable sheet of such labels, and a method for printing and/or applying the printed labels, such as by a consumer.

BACKGROUND OF THE INVENTION

Hang tabs are used for hanging a wide variety of small products on wire hangers of sales display racks. Hang tabs typically have an opening, usually in the general form of a short and wide triangle, with an apex for receiving a wire hanger and having a base broad enough for receiving a double wire hanger. Hang tabs can be adhered to the box or package they support. Adhesive hang tabs are often made of clear polyester resin that does not obscure the package the tab is adhered to.

SUMMARY OF THE INVENTION

The invention is directed to a label and method for forming a hang tab on an object. The label can be one of a plurality of labels on a label sheet or assembly, and can be fed through a consumer printer to create personalized hang tabs. Each label desirably includes a fold line creating two portions, each with a removable shape cut therein that, when the label is folded, align to create a hanger opening for receiving, for example, a wire hanger of a wall or display rack.

One embodiment of this invention includes a label for hanging an object including a first side with a printable surface, a second side coated with an adhesive material, and a fold line dividing the label into a first portion and a second portion. A first hanger opening shape is cut in the first portion, and a second hanger opening shape is cut in the second portion. The second hanger opening shape is a reversed duplication, or mirror image, of the first hanger opening shape. The first hanger opening shape and the second hanger opening shape can be disposed a same or equal distance from the fold line, thereby aligning the two opening shapes upon folding the label about the fold line. Each of the first hanger opening shape and the second hanger opening shape is a removable shape cut in the label that can be removed to provide a hanger opening, which can be sized and/or shaped as needed. Exemplary shapes include common conventional hanger tab shapes, such as a euro hanger opening shape, a delta hanger opening shape, or a J-hook hanger opening shape.

The first portion of the label desirably has a size and/or shape matching the second portion. The label can also include a second fold line disposed on a side of the second hanger opening shape opposite the fold line, and each of the fold lines is desirably a perforated cut across at least a portion of the label.

The label can be embodied on a label assembly including a face sheet, a back sheet or liner, and an adhesive layer disposed between the face sheet and the back sheet. The label assembly can include a plurality of label shapes each defined in the face sheet by at least one tearable line of separation. Each of the label shapes includes a first fold line between a first portion and a second portion, a first hanger opening shape cut in the first portion, a second hanger opening shape cut in the second portion, and a second fold line between the second portion and a third portion. The second hanger opening shape is a reversed duplication of the first hanger opening shape, and each of the first hanger opening shape and the second hanger opening shape is disposed a same distance from the first fold line to align when folded.

The invention further includes a method of applying a label, such as from a label assembly, to an object. The label assembly can be run through a printer to print any desired text, graphics, and/or readable code of the label. Referring to the label assembly described above, the third portion of the label (e.g., not including a hanger opening) is raised from the back sheet liner by folding about the second fold line to obtain a raised portion. The object is positioned against the label assembly with an edge of the object adjacent to, either against or near the raised portion, such that lowering the raised portion adheres the third portion to the object. The remaining portions of the label are removed from a remainder of the face sheet, and the label is folded about the first fold line to align the hanger opening shapes and adhere the first portion to the second portion and the object.

BRIEF DESCRIPTION OF THE D' WINGS

DESCRIPTION OF THE INVENTION

The present invention is directed to a self-adhesive label, and an assembly including a self-adhesive label, that can be applied to an object, preferably without the need for a separate application device. The object can be any object, such as items to hang for retail display. Embodiments of this invention are particularly suited for use with retail product packaging used in hanging retail displays, such as, without limitation, envelope packaging, cardboard backed packaging, plastic containers, and/or small items such as CD and DVD cases. The labels of this invention can also be used as a replacement hanger when a package hanger is broken.

Figure 1:
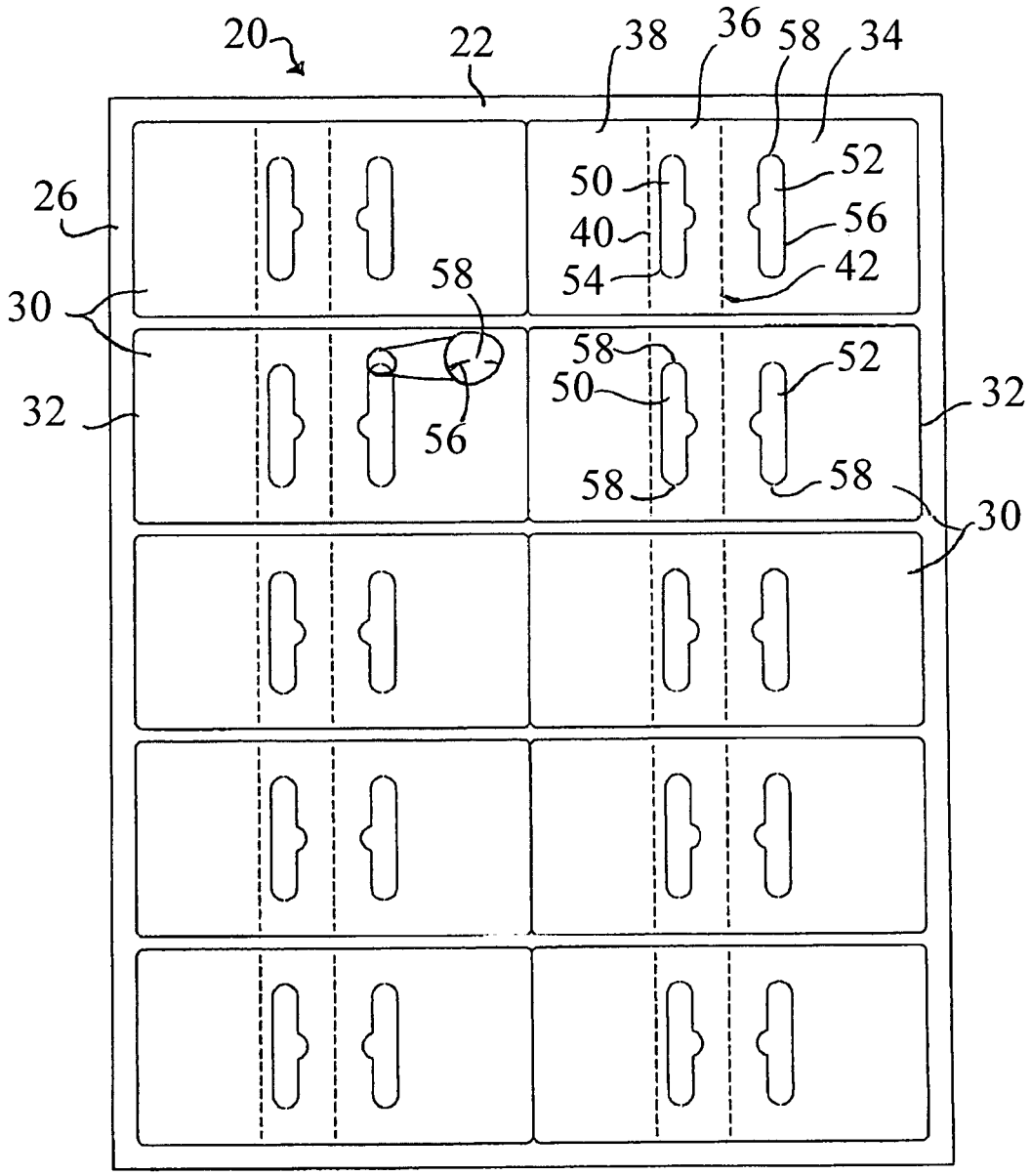
FIG. 1 is a top view of a label assembly according to one embodiment of this invention.
Figure 2:
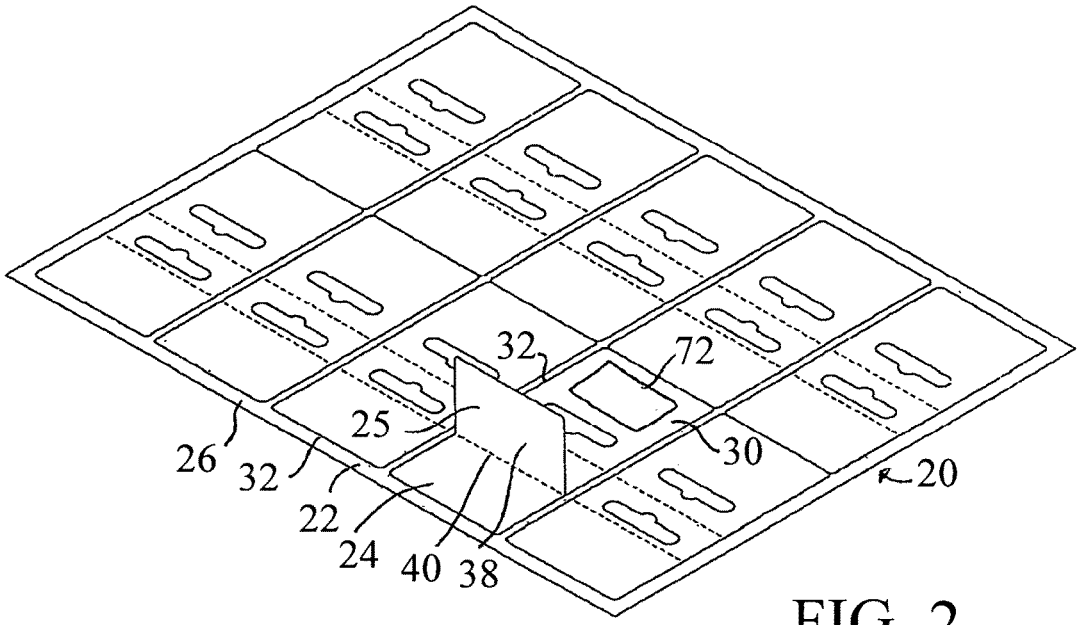
FIGS. 2-7 illustrate a method of application of a label using the label assembly of FIG. 1.

The label assembly of this invention includes a face sheet with at least one label shape defined by at least one tearable line of separation, a back sheet adjacent to the face sheet, and an adhesive material disposed between the face sheet and the back sheet. FIGS. 1 and 2 show a label assembly 20 (not necessarily shown to scale) according to one embodiment of this invention. Label assembly 20 is desirably formed of a face sheet 22 and a back sheet 24. The back sheet 24 is desirably about the same size as the face sheet 22, but may be slightly larger or smaller than the face sheet 22. The surface of the face sheet 22 that is disposed toward the back sheet 24 includes an adhesive material coating 25. The adhesive coating can include any adhesive material known and available to those skilled in the art for forming pressure sensitive, or self-adhesive, labels. The back sheet 24, also known as a release liner, is desirably formed of a material to which the adhesive coating adheres significantly less than to the face sheet 22, such as is known for forming pressure sensitive, or self-adhesive, labels.

The assembly 20 is of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches, however the size can be smaller or larger, depending on need and the label size and amount. The face sheet is preferably, but not necessarily, constructed of any suitable paper, paper composite, polymer r material, non-metal and/or metal material that can be used as a label. Other suitable materials for constructing the sheet include fabric, plastic, and metal foils. The adhesive coating covered by the hack sheet is applied to the face sheet in any suitable manner known to those skilled in the art. The face sheet desirably has a printable surface on a side opposite the adhesive coating.

The face sheet and the printable surface can be any of a variety of face materials used to make pressure sensitive or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. The face sheet can also be pre-printed by the manufacturer or retailer with graphics and/or text desirable to a consumer user. The printed surface can include any desirably image or text, or can be colored or include holographic images.

The face sheet 22 includes a plurality of label shapes 30, each defining in the face sheet 22 an individual label according to this invention. The phrase "shape", or the phrases "removable shape" or "tearable shape", is intended to relate to a shape, such as, but not limited to, the generally rectangular shape shown in FIG. 1 by element reference numeral 30, that can be torn away from a remaining portion 26 of the face sheet 22, by using tearable lines of separation 32. The term "tearable lines of separation," also referred to as simply "tearable lines," "lines of separation" or "separation lines," relate to physical or structural lines that can be torn to separate a removable portion or section from the remaining portion or section of the label and/or the label assembly according to this invention. The label of this invention may further include additional separation lines and/or lines of weakness and/or fold lines to aid in positioning and/or adhering the label around an object. Lines of separation and/or lines of weakness according to this invention can be formed of a die-cut line, a laser die-cut line, a score cut line, a perforation line (such as having a plurality of cuts and ties), a microperforation line, a chemically etched line, a liquid etched line, a gas etched line, or any combination of these types of separation, or any other suitable structure that enables separation. A preferred type of tearable line is a line that is die-cut. The label shape can be die-cut along at least a portion of a periphery, such that the label shapes can be easily removed or separated from the remaining portion of the assembly sheet, for example after the sheet is run through a printer. In one embodiment, a die cut line can include an occasional material bridge "tie" to further support any shape formed by the die cut line.

As shown in FIG. 1, each label shape 30 is divided into three portions 34, 36, and 38, by two parallel fold lines 40 and 42. In the embodiment of FIG. 1, fold line 42 is positioned at about a midpoint of the label shape 30, such as dividing the label shape 30 into two equal portions. The other fold line 40 is positioned between the fold line 42 and one end of the label shape 30. The fold lines 40 and 42 can be imaginary, such as a printed line, but are desirably real, in that the fold lines 40 and 42 are formed by an embossed, perforated, or other suitable cut line in the face sheet 22.

In one embodiment of this invention, third portion 38 corresponds to an attachment or adhering region for attaching and adhering to an object. Second portion 36 corresponds to a hanging region that extends beyond the object. First portion 34 desirably is sized to fold about fold line 42, cover the adhesive backing of portion 36, and attach to the object on an opposite side from third portion 38, as discussed further below. Various and alternative sizes, shapes, amounts, and configurations are available for the label assembly, label shapes, fold lines, and label portions according to this invention, depending on need and the object to be labeled.

Each label shape 30 includes two hanger opening shapes 50 and 52 cut within the periphery of the label shape 30. The shapes 50 and 52 are sized and shaped to provide a hanger opening in the label shape 30, through which a wire hanger rod can be disposed to hang an object. The shapes 50 and 52 are formed by tearable lines of separation 54 and 56, respectively. In one embodiment of this invention, the shapes 50 and 52 include material bridges or ties 58 extending through or dividing the tearable lines 54 and 56 on opposing ends of each of the shapes 50 and 52. The small, frangible ties 58 can be used to hold the cut shapes in place until removed by the user, thereby reducing or eliminating premature removal of the shapes 50 and 52, such as during printing.

Figure 6:
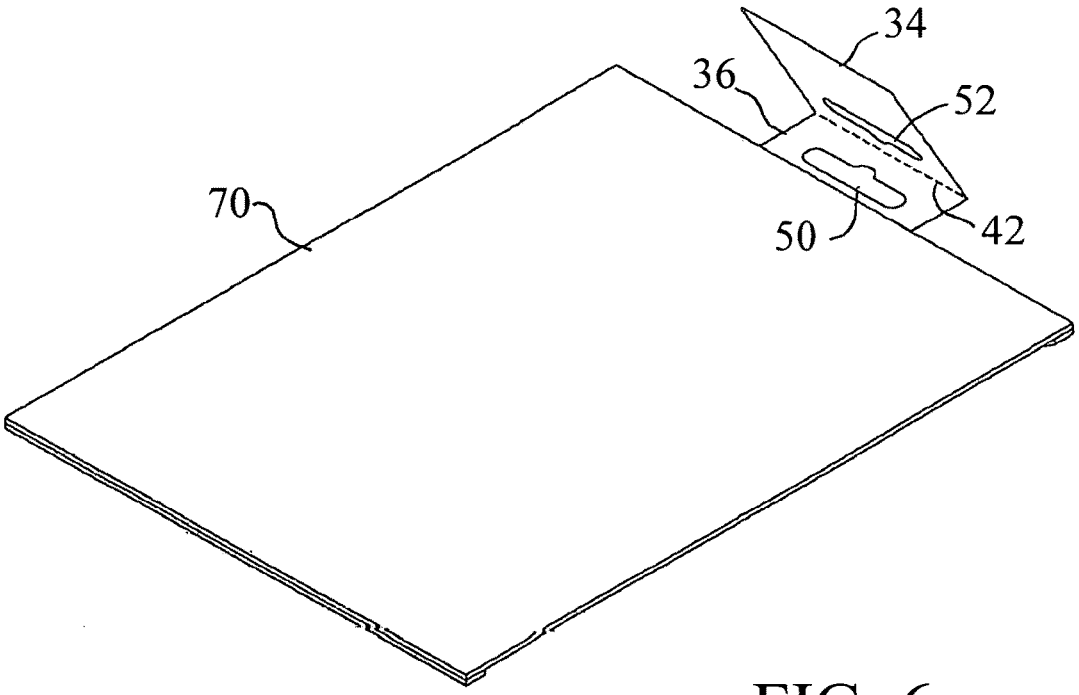
Figure 7:
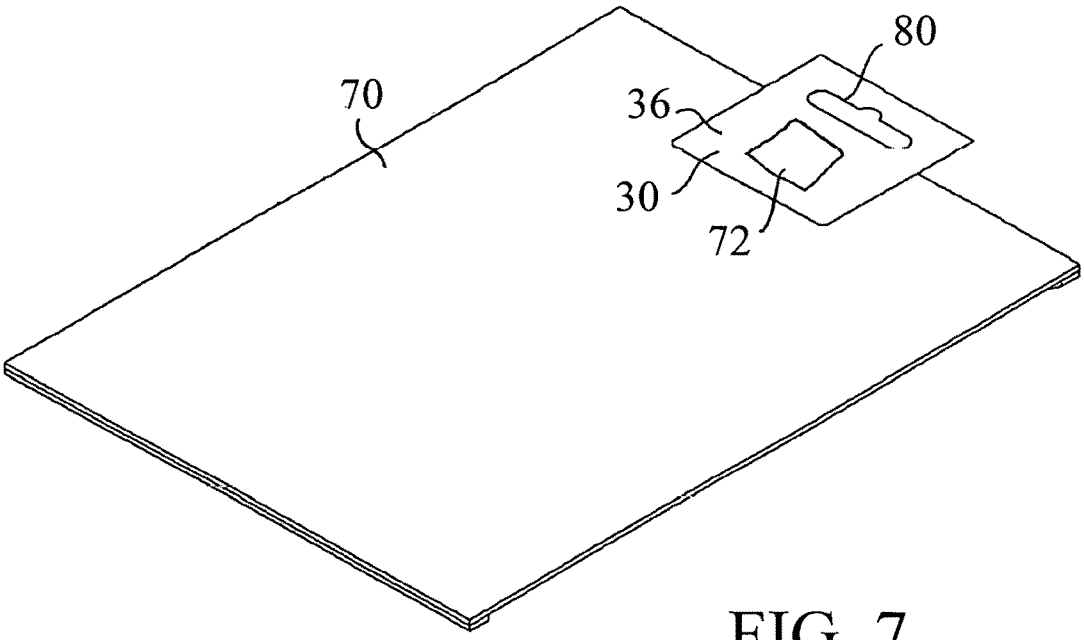

The second hanger opening shape 52 is desirably a reversed duplication of the first hanger opening shape 50. As used herein, a "reversed duplication" refers to an essentially identical second shape that has been reversed to form a mirror image of the first shape. The first and second shapes 50 and 52 are desirably each positioned as mirror images equidistant from the fold line 42, to allow the shapes 50 and 52 to align upon folding about fold line 42. As shown in FIG. 1, the shape 50 is cut in the second or hanging region portion 36 and the shape 52 is cut in the first portion 34, and the shapes will be positioned above the object upon applying the label shape, as shown in FIGS. 6 and 7, to allow for hanging.

Figure 8:
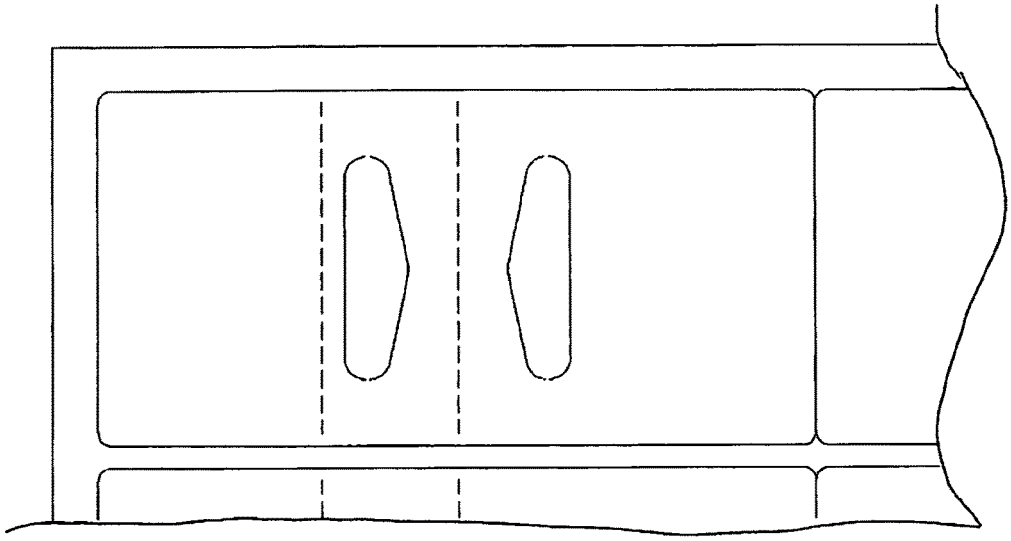
FIGS. 8 and 9 illustrate alternative hanger opening shapes, according to additional embodiments of this invention.
Figure 9:
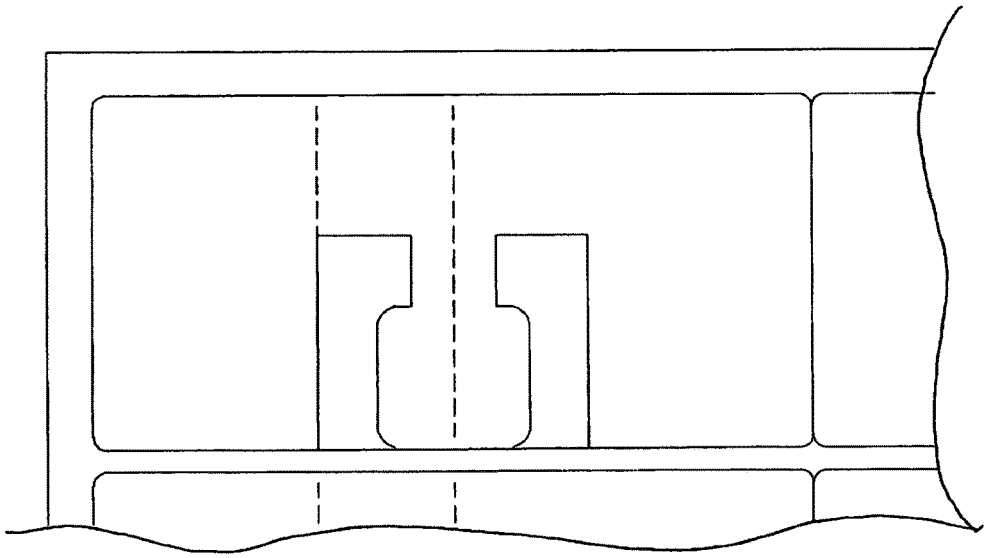

As shown in FIG. 1, the hanger opening shapes 50 and 52 include one conventional hanger tag shape, commonly referred to as the "euro" configuration, and can alternatively include other shapes, such as, without limitation, a circle or other rounded or oblong shape, a delta shape (i.e., a squat triangle) such as shown in FIG. 8, or a removable portion to form a J-hook shape as shown in FIG. 9.

FIGS. 2-7 illustrate the use of the label assembly 20 to label a front side of an object, shown as envelope 70. One, more than one, or all of the label shapes 30 can be printed upon before the assembly steps as shown in FIGS. 2-7, such as by routing the label assembly 20 through a laser or inkjet printer. Image and/or information can be printed on at least a portion of label shapes 30. As used herein, the terms "image" or "information" refer to any suitable or desirable print, barcode, name, logo, contact or product information, photograph, electronic image, such as a digital photograph, a picture, a color, a display drawing, a letter, a text, a number, a word and/or a symbol, and/or any other desirable image or information. For example, the label of this invention adhered to an object may include one or more decorative designs selected by the user and/or selected personal information. As shown in FIGS. 2-7, the label shape 30 applied to the envelope 70 includes printing 72, which can, for example, be company or product name and/or information, and printing 74, which can, for example, include a barcode.

Figure 3:
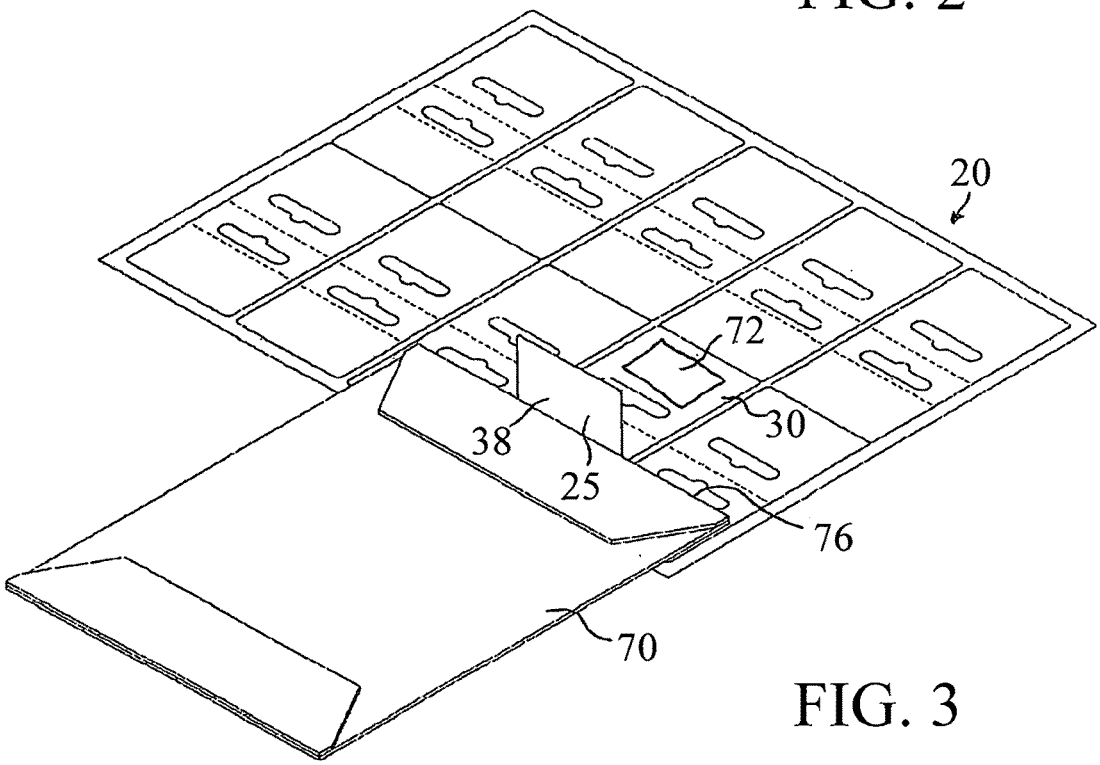

In FIG. 2, the third portion 38 is raised from the remaining portion 26 by breaking the surrounding tearable line 32 and folding along fold line 40. In FIG. 3, an end 76 of the envelope 70 is laid on the label assembly 20 with the third portion 38 in an upright, raised position. Alternatively, the envelope can be placed at an angle with an end 76 on the label assembly 20. The envelope 70 can be properly aligned with the label shape 30 by abutting the end 76 to the raised portion 38 and/or the label assembly 20 on a flat surface. The label of this invention allows for relatively easy and proper placement of this label 30 onto the envelope 70, without the need for a separate applicator device.

Figure 4:
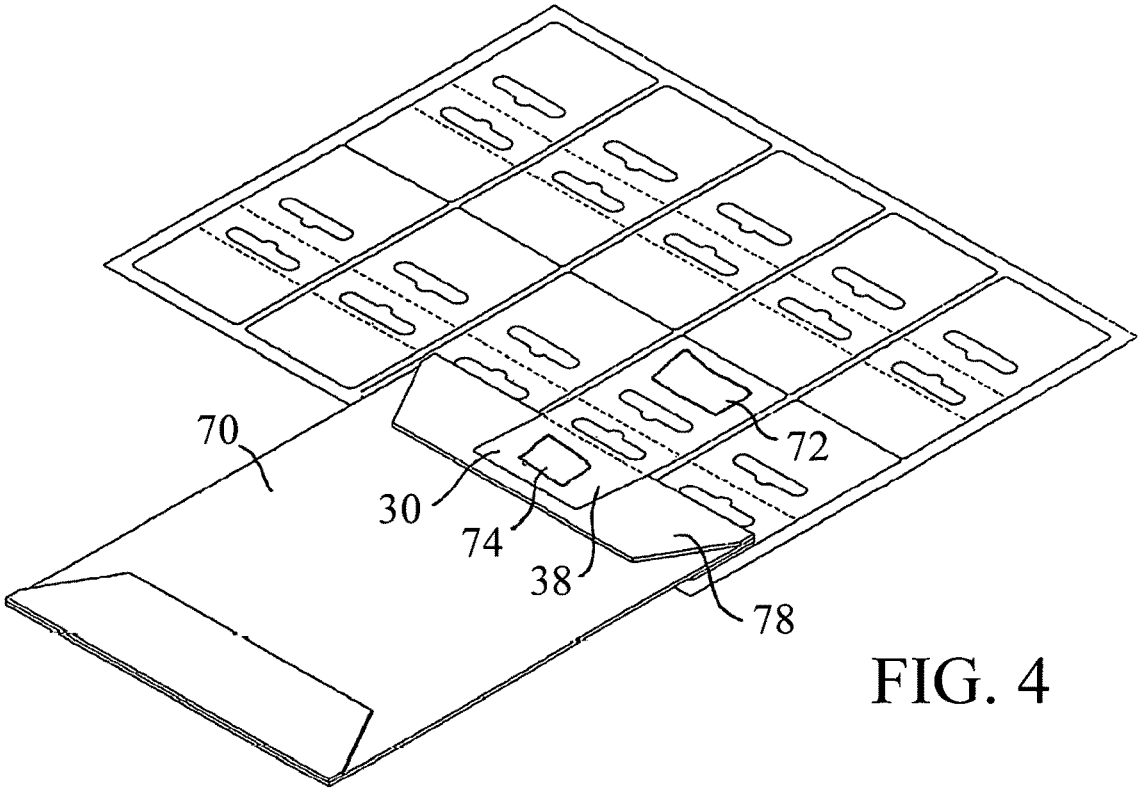
Figure 5:
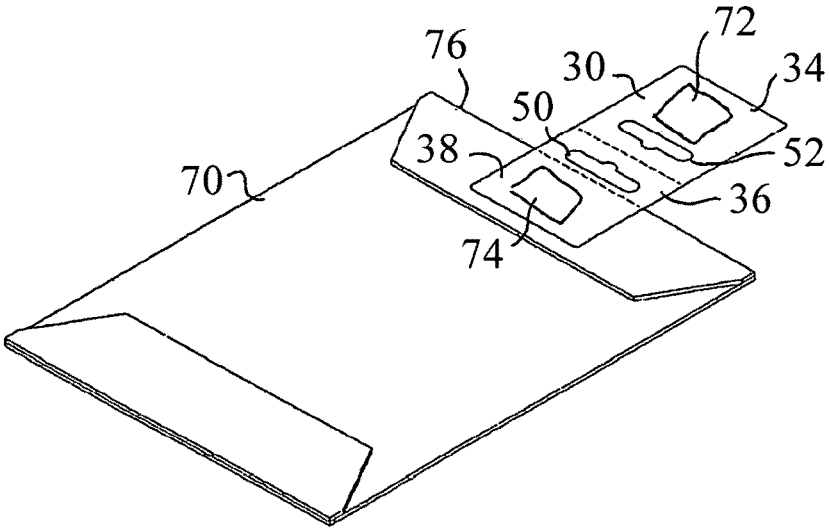

In FIG. 4, the raised portion 38 is lowered onto the upward facing surface 78 of the envelope 70 to adhere the third portion 38 to the envelope 70. Once adhered, the label shape 30 can be fully removed from the label assembly 20 as shown in FIG. 5. The second portion 36 extends beyond the end 76 of the envelope to appropriately position the shape 50 for use in hanging. In FIG. 6, first portion 34 is folded about fold line 42 to adhere to second portion 36 and envelope 70 on a side opposite third portion 38. FIG. 7 shows the label shape 30 fully applied to envelope 70, with printing 72 facing outward for viewing. The label shapes 50 and 52 are aligned and the removed by the user through breaking of tearable lines 54 and 56 and ties 58 to provide opening 80 for hanging envelope 70 on a wire display hanger.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method of applying a hang tab to a product for retail display, the method comprising:

providing a label assembly including a face sheet, a back sheet, an adhesive layer disposed between the face sheet and the back sheet, and a plurality of hang tab label shapes each defined in the face sheet by at least one tearable line of separation, each of the label shapes including a first fold line dividing the label into a first portion and a second portion, a first hanger opening shape cut in the first portion, a second hanger opening shape cut in the second portion, the second hanger opening shape comprising a reversed duplication of the first hanger opening shape, and a second fold line disposed on a side of the second hanger opening shape opposite the first fold line to define a third portion, wherein a longitudinal bottom edge of each of the first hanger opening and the second hanger opening is parallel to the second fold line;

raising the third portion of one of the plurality of hang tab label shapes from the back sheet by folding about the second fold line to obtain a raised portion;

positioning the product against the label assembly with a product edge adjacent the raised portion;

lowering the raised portion onto the product to adhere the third portion to the product;

adhering the first portion of the label to the product, wherein the product comprises envelope packaging to which the label is adhered; and hanging the product in the envelope packaging by the hang tab on a wire display hanger in a retail display.

2. The method of claim 1, wherein adhering the first portion of the label to the product comprises:

removing the first portion and second portion of the label from a remainder of the face sheet; and folding the label about the first fold line to adhere the first portion to the second portion and to the product.

3. The method of claim 1, wherein the face sheet comprises a remaining portion surrounding each of the plurality of label shapes.

4. The method of claim 1, wherein each of the first hanger opening shape and the second hanger opening shape is disposed a same distance from the first fold line.

5. The method of claim 1, wherein the first portion has a size and/or shape matching a combination of the second portion and the third portion.

6. The method of claim 1, wherein when folded about the first fold line the first hanger opening shape aligns with the second hanger opening shape.

7. The method of claim 1, wherein each of the first hanger opening shape and the second hanger opening shape comprises a removable shape cut in the label, wherein the removable shape is connected to the printable surface by at least one frangible tie.

8. The method of claim 1, wherein the fold line comprises a perforated line cut across the label.

9. The method of claim 1, wherein the first hanger opening shape comprises a euro hanger opening shape, a delta hanger opening shape, or a J-hook hanger opening shape.

10. The method of claim 1, wherein the third portion is a product adhering region and the second portion is a hanging region, the adhering region including a portion of the adhesive material and the hanging region including the second hanger opening shape, and further comprising adhering the adhering region to the product, and adhering the hanging region adheres to the first portion when folded about the first fold line.

11. A method of applying a hang tab to a product for retail display, the method comprising:

providing a label assembly including a face sheet, a back sheet, an adhesive layer disposed between the face sheet and the back sheet, and a plurality of hang tab label shapes each defined in the face sheet by at least one tearable line of separation, each of the label shapes including a first fold line between a first portion and a second portion, a first hanger opening shape cut in the first portion, a second hanger opening shape cut in the second portion, the second hanger opening shape being a reversed duplication of the first hanger opening shape, and a second fold line between the second portion and a third portion, wherein when folded about the first fold line the first portion extends beyond the second portion to overlap the third portion;

feeding the label assembly through a printer and printing on a first label;

raising the third portion of the first label from the back sheet by folding about the second fold line to obtain a raised portion;

positioning the product against the first label with a product edge adjacent the raised portion;

lowering the raised portion onto the product to adhere the third portion to the product;

adhering the first portion of the first label to the product by folding about the first fold line to form the hang tab from the first label; and hanging the product by the hang tab on a wire display hanger in a retail display.

12. The method of claim 11, wherein adhering the first portion of the label to the product comprises:

removing the first portion and second portion of the label from a remainder of the face sheet; and folding the label about the first fold line to adhere the first portion to the second portion and the product.

13. The method according to claim 11, further comprising each of the first hanger opening shape and the second hanger opening shape disposed a same distance from the first fold line.

14. The method according to claim 11, wherein the first fold line is at a midpoint of the label and divides the label into two equal halves, a first of the two equal halves including the first portion, and a second of the two equal halves including the second portion and the third portion.

15. The method according to claim 11, wherein the second fold line is disposed on a side of the second hanger opening shape that is opposite the first fold line.

16. The method according to claim 11, wherein when folded about the first fold line the first hanger opening shape aligns with the second hanger opening shape.

17. The method according to claim 11, wherein each of the first hanger opening shape and the second hanger opening shape comprises a removable shape cut in the face sheet, wherein the removable shape is connected to the printable surface by at least one frangible tie.

18. The method according to claim 11, wherein each of the first fold line and the second fold line comprises a perforated line cut across the label shape.

19. The method according to claim 11, wherein the third portion is a product adhering region and the second portion is a hanging region, the adhering region including a portion of the adhesive material and the hanging region including the second hanger opening shape, and further comprising adhering the adhering region to the product, and adhering the hanging region adheres to the first portion when the first label is folded about the first fold line.

* * * * *